United States Patent [19]

Copland

[11] Patent Number: 4,470,459

[45] Date of Patent: Sep. 11, 1984

[54] APPARATUS AND METHOD FOR CONTROLLED TEMPERATURE HEATING OF VOLUMES OF HYDROCARBONACEOUS MATERIALS IN EARTH FORMATIONS

[75] Inventor: George V. Copland, Duncan, Okla.

[73] Assignee: Halliburton Company, Duncan, Okla.

[21] Appl. No.: 492,975

[22] Filed: May 9, 1983

[51] Int. Cl.[3] ..... E21B 36/04; E21B 43/24

[52] U.S. Cl. ..... 166/248; 166/50; 166/60; 166/65 R

[58] Field of Search ..... 166/52, 50, 60, 65 R, 166/245, 248, 302

[56] References Cited

U.S. PATENT DOCUMENTS

| | | | |
|---|---|---|---|
| 4,135,579 | 1/1979 | Rowland et al. | 166/248 |
| 4,140,180 | 2/1979 | Bridges et al. | 166/248 |
| 4,193,451 | 3/1980 | Dauphine | 166/248 |
| 4,265,307 | 5/1981 | Elkins | 166/248 |
| 4,301,865 | 11/1981 | Kasevich et al. | 166/248 |

*Primary Examiner*—George A. Suchfield
*Attorney, Agent, or Firm*—W. J. Beard

[57] ABSTRACT

The disclosure relates to a technique for controlled or uniform temperature heating of a volume of hydrocarbonaceous material in an earth formation employing conductor arrays, inserted in the formation, for applying radio frequency energy to the formation. The number and spacing of conductors in the arrays are selected to provide a concentration of electric field intensity at the extremities of the volume to facilitate controlled or uniform temperature heating of the volume. The arrangement compensates for temperature variations across the volume caused by heat flow within the volume and heat loss to the surrounding formation.

13 Claims, 5 Drawing Figures

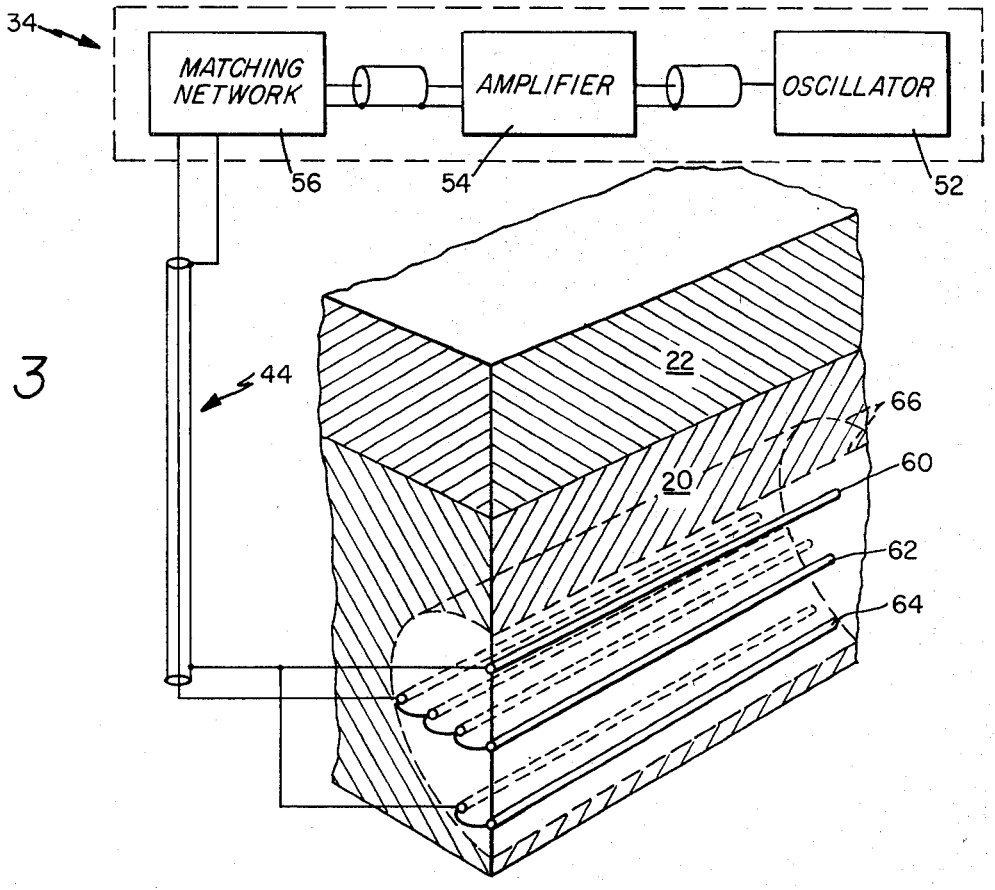
FIG. 3
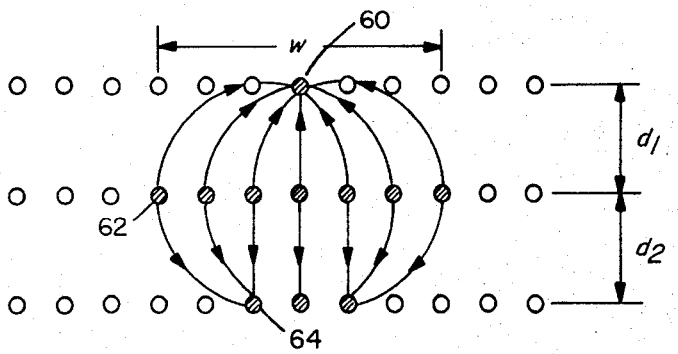
FIG. 4
FIG. 5
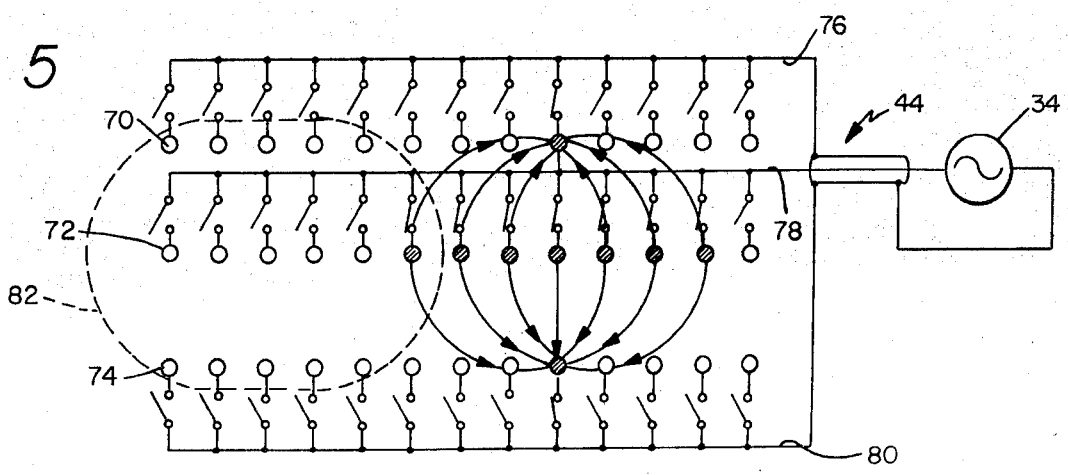

APPARATUS AND METHOD FOR CONTROLLED TEMPERATURE HEATING OF VOLUMES OF HYDROCARBONACEOUS MATERIALS IN EARTH FORMATIONS

BACKGROUND OF THE INVENTION

This invention relates to the recovery of marketable products such as oil and gas from hydrocarbon bearing deposits such as oil shale or tar sand by the application of radio frequency energy to heat the deposits. More specifically, the invention relates to an arrangement of conductors, inserted in the formation, for applying the energy to achieve approximately uniform, elevated temperatures in a selected volume of material in the formation.

This country's reserves of oil shale and tar sand contain enough hydrocarbonaceous material to supply this nation's liquid fuel needs for many years. A number of proposals have been made for processing and recovering hydrocarbonaceous deposits, which are broadly classed as "in situ" methods. Such methods may involve underground heating or retorting of material in place, with little or no mining or disposal of solid material in the formation. Useful constituents of the formation, including heated liquids of reduced viscosity, may be drawn to the surface by a pumping system or forced to the surface by injection techniques. It is critical to the success of such methods that the amount of energy required to effect the extraction be minimized. Unfortunately, exploitation of hydrocarbonaceous deposits employing conventional in situ technology has not occurred on a large scale for economic reasons.

It has been proposed that relatively large volumes of hydrocarbonaceous formations be heated in situ using radio frequency energy. These proposals are exemplified by the disclosures of the following patents: U.S. Pat. No. 4,144,935 to Bridges et al, now U.S. reissue application Ser. No. Re. 118,957 filed Feb. 2, 1980 now U.S. Pat. No. Re. 30,738; U.S. Pat. No. 4,140,180 to Bridges et al, U.S. Pat. No. 4,135,579 to Rowland et al; U.S. Pat. No. 4,140,179 to Kasevich et al; and U.S. Pat. No. 4,193,451 to Dauphine.

The attainment of controlled or uniform temperature heating of a volume to be recovered is a desirable result. Non-uniform temperature distributions can result in the necessity of inefficient overheating of portions of the formations in order to obtain the minimum average heating necessary to facilitate recovery of the useful constituents in the bulk of the volume being processed. Extreme temperatures in localized areas may cause damage to the producing volume such as carbonization and arcing between the conductors.

Dauphine et al teaches techniques for attaining a more uniform dispersion of a radio frequency field. Rowland likewise indicates a preference for a uniform field pattern in discussing his four conductor embodiments shown in his FIG. 3. Finally, the Bridges et al disclosures teach the desirability of achieving uniform heating of a particular volume of the hydrocarbonaceous material. Embodiments disclosed by Bridges et al call for the heating of blocks of oil shale or tar sand by enclosing or bounding of the volume in an electrical sense with arrays of spaced conductors. One such array consists of three spaced rows of conductors which form the so-called "triplate-type" of transmission line structure similar to that shown in FIG. 2 of this application.

Uniformity of heating is predicted by Bridges et al as a result of a time-averaged uniformity in the intensity of the electric field within the triplate structure. This approximation assumes that the diminution of the electric field in any direction due to transfer of energy to the formations is not so severe as to cause undue non-uniformity of heating in the volume and wasteful overheating of portions thereof.

Despite the application of uniform fields, which are predicted to cause uniform heating, non-uniformity of temperature has been observed in tests employing the Bridges triplate structure. This non-uniformity may be caused by heat loss to the formation surrounding the bounded volume. As a result, in at least some formations and configurations of the bounded volume, the extremities of the volume may be significantly cooler than the central portion of the volume.

Accordingly, it is a feature of the present invention that subsurface formations be heated to a controlled or uniform temperature with radio frequency energy.

It is another feature of the present invention that a volume of hydrocarbonaceous material heated with radio frequency energy be configured to minimize heat loss at the extremities of the volume.

It is another object of the present invention to provide an apparatus and method for heating a volume of hydrocarbonaceous material to uniform temperatures in situ by compensating for heat loss to the surrounding formation.

The substantial confinement of the radio frequency energy to the volume of material which is to be heated is important for feasible extraction techniques. This is so for two reasons. First, the application of radio frequency energy to surrounding material which are not heated sufficiently to permit production of oil and gas is a waste of that energy. Second, large amounts of radiated radio frequency energy may interfere with radio cummunications above-ground.

Accordingly, it is another feature of the present invention that a subsurface volume in an earth formation be heated in a controlled or uniform fashion with radio frequency energy, while minimizing radiation of the radio frequency energy into surrounding environs.

These and other features of the invention will become apparent from the claims, and from the following description when read in conjunction with the accompanying drawings.

SUMMARY OF THE INVENTION

Applicant has devised a technique for controlled or uniform temperature heating of volumes of a hydrocarbonaceous formation to convert kerogen therein to recoverable oil, gas, or other useful materials. The technique employs a signal generator or radio frequency transmitter for providing an electrical signal of a frequency in the range of from 100 kilohertz to 100 megahertz. The electrical signal is applied to conductor arrays located in spaced boreholes in the formation. An important aspect of the present invention is that the conductor arrays are arranged and excited to provide a concentration of field intensity about at least some conductors near the surface of the heated volume. This field intensity distribution is tailored to provide heating effects, which when combined with heat flow effects in the formation and heat loss effects to the formation surrounding the volume, yield more uniform heating of the volume. Another aspect of the present invention is that the conductor arrays may be arranged to define a heated volume having a surface to volume ratio less than the approximately planar sided blocks which the prior art attempts to heat. This arrangement facilitates the attainment of uniform temperatures throughout a region in the formation.

In one embodiment of the present invention, three approximately parallel rows of bore holes are provided in the formation. The boreholes may be vertical, horizontal or inclined. Adjacent boreholes in each row are separated by a distance less than ¼ of the wavelength of the exciting electrical signal. Elongated electrical conductors may be inserted into all or at least some of the boreholes in the three rows. A switch network may be provided for selectively interconnecting the conductors of the rows with the electrical signal generator. The electrical signal may be applied to selected conductors in the rows to raise the temperature of a first volume in the formation and to provide a concentration of field intensity about at least some of the electrodes near the surface of the volume to compensate for heat loss to the formations surrounding the volume. In a similar fashion, when the first volume is sufficiently heated to permit production of oil and gas from the volume, others of the conductors in the rows may be interconnected and the electrical signal applied to other conductors to heat a different, approximately cylindrical volume in the formation.

In another embodiment of the present invention, horizontally extending conductors are inserted into the hydrocarbonaceous formation. Three rows of conductors may be provided: a central conductor array comprising a line of approximately parallel conductors inserted in approximately horizontal boreholes; an upper conductor array comprising at least one conductor inserted in a borehole approximately parallel to the conductors of the cental array, and a lower conductor array comprising at least one conductor inserted in an approximately horizontal borehole located below the central array. Advantageously, the distance between the central conductor array and the upper conductor array is smaller than the distance between the central conductor array and the lower conductor array. The central conductor array may extend horizontally further than either the upper or lower conductor arrays and the lower conductor array may extend horizontally further than the upper conductor array. This arrangement provides additional compensation for temperature non-uniformities caused by downward fluid migration.

BRIEF DESCRIPTION OF THE DRAWINGS

FIG. 3 is a schematic diagram and pictorial view in phantom and partial cross-section illustrating an emodiment of the present invention usable in application employing horizontal conductor arrays.

FIG. 4 is a plan view of the embodiment of FIG. 3 illustrating the conductor arrangements and the resulting electric field lines.

FIG. 5 is a schematic diagram and plan view of an embodiment of the present invention, illustrating the selective connection of conductors in a three row array and the resulting electric field lines.

DETAILED DESCRIPTION

As an introduction to the description of embodiments of the present invention, a description will be provided of the general nature of the prior art heating apparatus disclosed by Bridges et al in their above mentioned patents.

Figure 1:
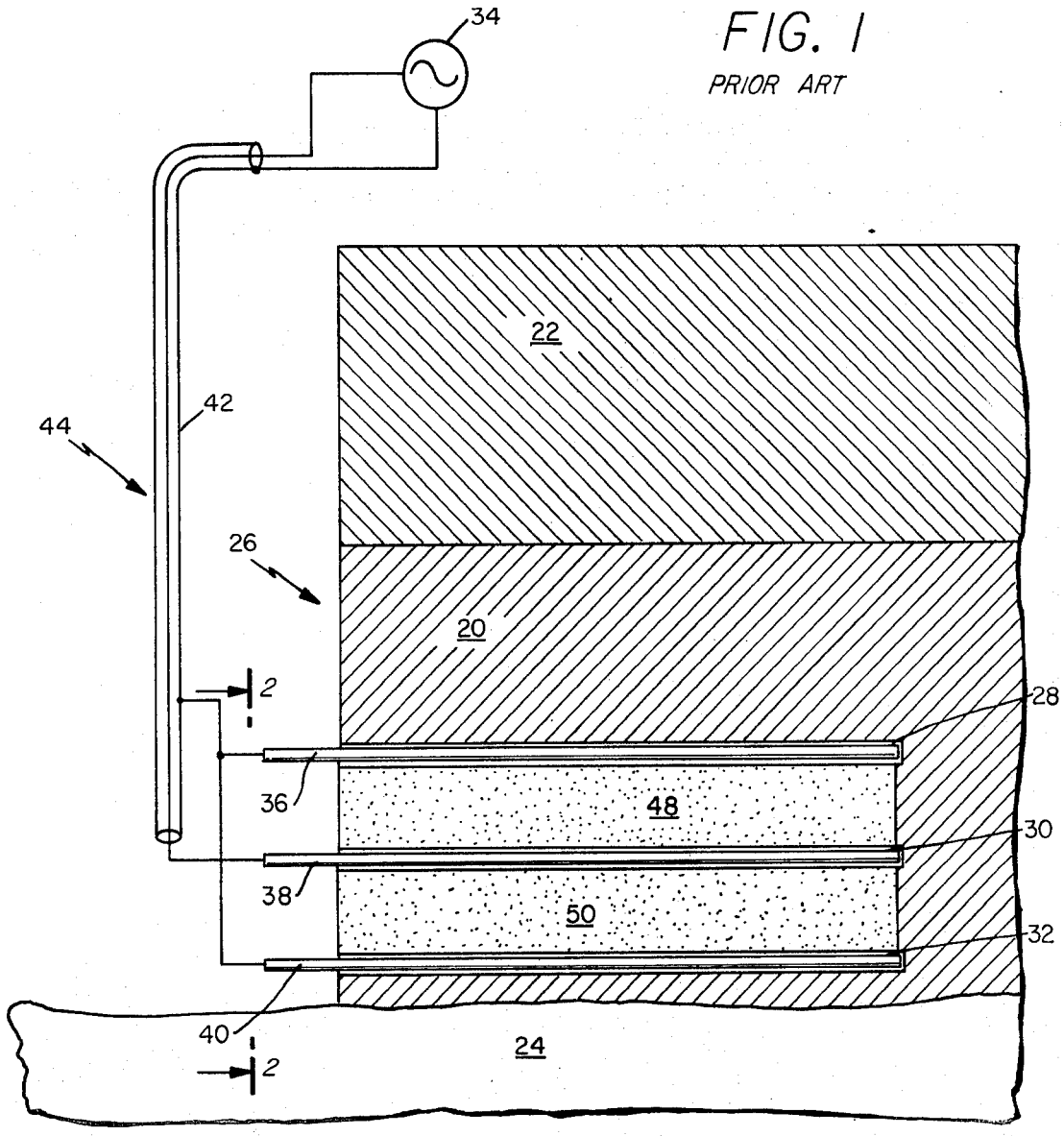
FIG. 1 PRIOR ART
FIG. 1 is a schematic diagram and side view, in partial cross-section, of a prior art triplate transmission line structure, embedded in an earth formation.
Figure 2:
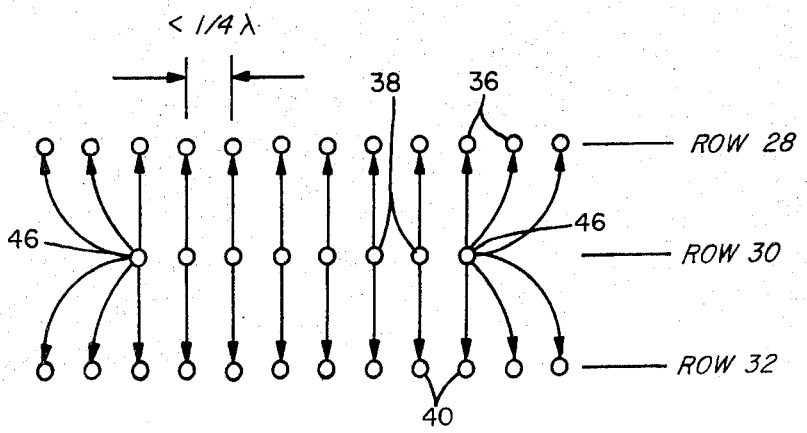
FIG. 2 PRIOR ART
FIG. 2 is a sectional view of the prior art structure of FIG. 1 showing the resulting electric field lines.

Referring first to FIGS. 1 and 2, a prior art device for applying radio frequency energy to a hydrocarbonaceous formation is shown. The hydrocarbonaceous bed is denoted generally by the numeral 20. Such a hydrocarbonaceous bed may be situated between a barren overburden 22 and a barren substratum 24. The hydrocarbonaceous bed 20 may be oil shale and, advantageously, a strata of oil shale such as that known as the "Mahogany" zone, which is characterized by a high concentration of kerogen per unit volume. Access to the hydrocarbonaceous bed 20 may be obtained through a face 26 of the bed. The face 26 may be the surface of a mined or drilled access shaft or the surface of a natural bed outcropping. Elongated horizontal boreholes in rows 28, 30 and 32 may be mined or drilled through the face 26 into the bed 20.

FIG. 2 is a sectional view taken along the line 2—2 in FIG. 1, showing the location of individual boreholes comprising the rows 28, 30 and 32. Conductors 36, 38 and 40 are inserted in the boreholes. As illustrated in FIG. 2, the separation between adjacent conductors in the same row is less than one quarter of the wavelength of the radio frequency signal to be applied to the array.

A high power radio frequency generator 34 is provided to apply an electrical signal to conductors 36, 38 and 40 via a coaxial transmission line 44. The upper conductors 36 and lower conductors 40 may be connected to a grounded shield 42 of the coaxial transmission line 44. The central conductors 38 may be connected to an inner conductor of the coaxial transmission line 44.

As indicated in FIG. 2, when a radio frequency signal is applied to the arrays, field intensity lines run from the central conductors 38 to the upper and lower conductors 36 and 40. The dielectric heating of the formation is approximately proportional to the square of the electric field intensity. Where field intensity is uniform, heating should be uniform, absent other factors. As will be readily apparent from FIG. 2, the field intensity lines are roughly uniform in their spacial distribution, except for the outermost conductors 46 of the central row in the vicinity of which some fringe effects and field concentration may occur. Theoretically, in a formation bed having approximately uniform electrical characteristics, very low thermal conductivity, and no migration of fluids, the application of a time averaged uniform electric field to the formation would result in substantially uniform heating of the formation between the upper and lower rows of conductors. Unfortunately, these approximations may not be met in practical application of the technique. Thermal conduction may cause time enhanced heating around the center electrodes, and lost heat from the region around the outer conductors.

As a result, non-uniform temperatures may occur. The nature of this non-uniformity is indicated in FIG. 1. Temperature differences are denoted by dots, the higher densities of the dots being approximately proportional to the higher temperatures observed in the volume. As will be clear from FIG. 1 the highest temperatures are found to occur around the central row of conductors 38. The observed temperature decreases both upwardly and downwardly from the central row of conductors 38 to minimums at the upper row 36 and lower row 40. The observed temperature adjacent lower row 40 is somewhat higher than the temperature adjacent to the upper row 36. This non-uniformity may be explained by at least two physical processes occurring during the heating of the formation. First, real hydrocarbonaceous formations exhibit some non-negligible thermal conductivity. As a result, heat flow effects cause higher temperatures near the center of the volume and heat is lost to the surrounding formation from extremities of the heated volume: the regions 48 and 50 adjacent the upper row of conductors 36 and the lower row of conductors 40, respectively. This effect reduces the temperature at the extremities of the heated volume, while time enhanced heating occurs around the central conductors. Second, heated fluids in the heated volume tend to migrate downward through the formation due to the force of gravity. This may account for the fact that higher temperatures are observed in region 50 than in region 48.

Efficient recovery of oil and gas constituents from a hydrocarbonaceous bed will typically require that the recovered volume be heated to temperatures above 200° C. At such temperatures useful consituents including the trapped oil and gas, will be released. However, excessive localized temperatures waste energy and may cause cracking, coking or burning of the materials sought to be extracted. Accordingly, the nonuniformities of temperature observed in or predicted for the prior art techniques may seriously hamper recovery in many types of formations. This is particularly, true in recovery from blocks of material having a high ratio of surface area to volume and, hence, a proportionally higher heat loss to surrounding formations.

FIGS. 3 and 4 illustrate a preferred embodiment of the present invention for heating volumes of a hycrocarbonaceous earth formation employing approximately horizontal conductors. In a preferred embodiment of the present invention, the signal generator 34 may consist of a radio frequency oscillator 52, the output signal of which is applied to a high power amplifier 54. The output signal from the amplifier 54 is coupled to a matching network 56 which assures that the amplifier 54 will operate into a load of approximately constant impedance in spite of variations in the impedance of the load, which comprises the conductor arrays and the formation.

As shown in FIG. 3, horizontally elongated boreholes are formed in the hydrocarbonaceous formation 20. Three conductors arrays may be inserted into the boreholes: an upper conductor array 60, a central conductor array 62 and a lower conductor array 64. As used herein, the term "conductor array" is used to indicate one or a series of electrically interconnected conductors excited substantially in phase. Depending on their alignment and spacing, such arrays may resemble, electrically, parallel plates at the frequencies employed. In some embodiments, these conductors within the array are spaced from one another a distance of less than $\frac{1}{4}$ of the wavelength of the electrical signal applied on the arrays. Advantageously, the spacing separations may be less than $\frac{1}{8}$ of the aforementioned wavelength.

FIG. 4 is a sectional view of the conductor arrays shown in FIG. 3 taken along plane 4—4. It will be clear that the width w of the central array 62 is greater than the width of the upper array 60 or lower array 64. Several consequences may flow from this arrangement. As indicated by the field lines in FIG. 4, the electric field is largely confined to a cylindrical volume. This volume is indicated approximately by the dotted line 66 in FIG. 3. The arrangement will act as an essentially non-radiating transmission line and heating effects of the electric field will be largely confined to the desired volume. It will be clear that such volume may be cylindrical and have a smaller surface to volume ratio than a rectangular solid block or cube of the same volume. Accordingly, heat loss from the extremities of the heated volume to the surrounding formations should be reduced, in contrast to the approximately planar-sided block which is heated by the apparatus of FIGS. 1 and 2.

In spite of the reduction in length of the upper and lower conductor arrays 60 and 64 over that shown in FIG. 2, these arrays nevertheless will function as guard arrays to minimize the amount of radio frequency energy radiated from the apparatus into the surrounding area. This, in turn, will reduce undesirable interference with radio communications which may be experienced when radiating antenna like structures are employed to heat formations.

Compensation for the migration of heated fluids in the formation may be made as indicated in FIG. 4. Specifically, the distance $d_1$ between the upper array 60 and the central array 62 may be smaller than the distance $d_2$ between the central array 62 and the lower array 64. In addition, the width w of the central array 62 may be greater than the width of either the upper array 60 or the lower array 64. The width of the lower array 64 is, however, greater than the width of the upper array 60. As a result of this arrangement, the field intensity lines are most concentrated about the upper array 60, thereby focusing greater amounts of radio frequency energy in that region. A lesser degree of focusing is provided around the lower array 64 since less energy is required due to the fluid migration above discussed. Appropriate selection of the widths and separations of the conductor arrays 62 and 64 will provide compensation for nonuniformities in the heating of the volume. This selection is made so that the squared dielectric heating effects combined with the heat flow effects due to thermal conduction yield approximately uniform temperature increases throughout the volume to be heated.

FIG. 5 includes a plan view of a generalized series of conductor arrays which may be employed either in vertical or horizontal applications. The arrays are inserted in parallel rows of boreholes 70, 72 and 74. Conductors located in these boreholes may be selectively connected to the signal generator 34 in different successive volumes of the formation. In FIG. 5 the excited conductors are denoted by darkened circles while the empty boreholes or unexcited conductors are denoted by open circles. If only the conductors to be connected to the signal generator are inserted in the boreholes and adjacent boreholes are left empty, parasitic distortions of the electric field by unconnected conductors may be avoided. Switching networks 76, 78 and 80 are provided for selectively connecting the conductors in the conductor arrays to the signal generator 34.

In operation, radio frequency energy could be applied to the conductors indicated by the darkened circles in FIG. 5 to provide the desired pattern of heating within a volume in the formation. Simultaneously or subsequently, the switching networks could be employed to define different conductor arrays to heat an adjacent volume of the formation denoted by the dotted line 82. In this way, different heated volumes or regions could be produced along the rows of boreholes.

The principles, preferred embodiments and modes of operation of the present invention have been described in the foregoing specification. The invention which is intended to be protected herein, however, is not to be construed as limited to the particular forms disclosed, since these are to be regarded as illustrative rather than restrictive. Variations and changes may be made by those skilled in the art without departing from the spirit of the invention.

What is claimed is:

1. An apparatus for in situ heating of a volume of a hydrocarbonaceous formation to convert kerogen therein to recoverable oil and gas comprising:

electrical excitation means for providing an electrical signal of a frequency in the range of from 100 kilohertz to 100 megahertz; and conductor arrays, electrically connected to said excitation means and inserted in spaced boreholes in the formation, and comprising means for providing a relatively greater concentration of field intensity about conductors near the surface of said volume and a relatively lesser concentration of field intensity about conductors in the interior of said volume, thereby compensating for heat flow in the volume and heat loss to the formation surrounding said volume.

2. The apparatus of claim 1 wherein the arrays are arranged to define the heated volume to be recovered as having a surface to volume ratio less than that of a cube of equal volume.

3. A method for in situ heating of a volume of a hydrocarbonaceous formation to permit recovery of hydrocarbon products therein, comprising:

generating an electrical signal of a frequency in the range of from 100 kilohertz to 100 megahertz;

providing a first outer row of borehole penetrating the formation, adjacent boreholes being separated by a distance less than ¼ of the wavelength of the electrical signal;

providing a second outer row of boreholes penetrating the formation, adjacent boreholes being separated by a distance less than ¼ of the wavelength of the electrical signal, said second outer row being parallel to and spaced from said first outer row of boreholes;

providing a central row of boreholes penetrating the formation, adjacent boreholes being separated by a distance less than ¼ of the wavelength of the electrical signal, said central row being parallel to and spaced between said first and second outer rows of boreholes;

inserting elongated conductors into at least some of said boreholes;

interconnecting at least some adjacent conductors of the central row;

selectively applying said electrical signal to said interconnected conductors of the central row and selected conductors of the outer rows to heat a first, volume in the formation and to provide a concentration of field intensity about at least some of the electrodes near the extremities of said volume to compensate for heat flow in the volume and heat loss to the formation surrounding said volume to effect a substantially uniform temperature rise throughout the volume; and selectively applying the electrical signal to conductors in different boreholes in the rows to heat a different volume in the formation.

4. An apparatus for in situ heating of a volume of a hydrocarbonaceous formation comprising:

means for generating an electrical signal of a frequency in the range of from 100 kilohertz to 100 megahertz;

a first outer row of elongated conductors penetrating the formation, adjacent elongated conductors being separated by a distance less than ¼ of the wavelength of the electrical signal;

a second outer row of elongated conductors penetrating the formation, adjacent boreholes being separated by a distance less than ¼ of the wavelength of the electrical signal, said second outer row being parallel to and spaced from said first outer row of conductors;

a central row of conductors penetrating the formation, adjacent conductors being separated by a distance less than ¼ of the wavelength of the electrical signal, said central row being parallel to and spaced between said first and second outer rows of conductors;

means for selectively interconnecting the conductors of the central row; and means for selectively applying said electrical signal to said interconnected conductors of the central row and selected conductors of the outer rows to heat volumes in the formation and to provide a concentration of field intensity about at least some of the electrodes near the surface of said volumes to compensate for heat flow in the volume and for heat loss to the formation surrounding said volume.

5. An apparatus for in situ heating of a volume of oil shale to convert kerogen in the oil shale into oil and gas for recovery comprising:

electrical excitation means for providing an electrical signal of a frequency in the range of from 100 kilohertz to 100 megahertz;

a central conductor array, electrically connected to said excitation means, comprising a line of approximately parallel conductors inserted in approximately horizontal boreholes in the formation;

an upper conductor array, electrically connected to said excitation means, comprising at least one conductor inserted in a borehole approximately parallel to the conductors of said central conductor array and located above said central conductor array; and a lower conductor array, electrically connected to said excitation means, comprising at least one conductor inserted in an approximately horizontal borehole located below said central conductor array;

said conductor arrays comprising means for compensating for heat loss to the surrounding formation by increasing field concentration at extremities of the heated volume to be recovered.

6. The apparatus of claim 5 wherein the conductors of the central conductor array are excited out of phase with the conductors of the upper and lower conductor arrays.

7. The apparatus of claim 6 wherein the conductors of each array are spaced a distance of less than one quarter of the wavelength of the electrical signal;

8. The apparatus of claim 7 wherein the spacing between the central conductor array and the upper conductor array is a distance $d_1$, which is less than one quarter of the wavelength of the electrical signal.

9. The apparatus of claim 8 wherein the spacing between the central conductor array and the lower conductor array is a distance $d_2$, which is less than one quarter of the wavelength of the electrical signal repressed thereon.

10. The apparatus of claim 9 wherein the horizontal width of the central conductor array is larger than that of upper and lower conductor arrays.

11. The apparatus of claim 10 wherein the distance $d_2$ is greater than the distance $d_1$, and wherein the horizontal width of the lower conductor array is larger than that of the upper conductor array, whereby, compensation is provided for heat loss to the surrounding formation due to downward fluid migration.

12. An apparatus for in situ heating of a volume of a hydrocarbonaceous formation to convert kerogen therein to recoerable oil and gas comprising:

electrical excitation means for providing an electrical signal of a frequency in the range of from 100 kilohertz to 100 megahertz; and an unbalanced transion line comprising:

a first conductor array located in the formation adjacent the surface of said volume and, electrically connected to said excitation means; and a second conductor array having at least one conductor near the surface of said volume and at least one conductor in the interior of said volume;

conductors of said arrays and said excitation means comprising means for providing a relatively greater concentration of field intensity about conductors adjacent the surface of said volume to compensate for heat loss to the formation surrounding said volume.

13. An apparatus for in situ heating of a volume of a hydrocarbonaceous formation comprising:

means for generating an electrical signal of a frequency in the range of from 100 kilohertz to 100 megahertz;

a first array of one or more elongated conductors selectively inserted in a first outer row of boreholes penetrating the formation, adjacent elongated conductors being separated by a distance less than $\frac{1}{4}$ of the wavelength of the electrical signal;

a second array of one or more elongated conductors selectively inserted in a second outer row of boreholes penetrating the formation, adjacent boreholes being separated by a distance less than $\frac{1}{4}$ of the wavelength of the electrical signal, said second array being parallel to and spaced from said first array of conductors;

a third array of one or more conductors selectively inserted in a central row of boreholes penetrating the formation, adjacent conductors being separated by a distance less than $\frac{1}{4}$ of the wavelength of the electrical signal, said third array being parallel to and spaced between said first and second arrays of conductors;

means for applying said electrical signal to the conductors of the arrays to heat approximately cylindrical volumes in the formation and to provide a concentration of field intensity about at least some of the conductors near the surface of said cylindrical volumes to compensate for heat loss to the formation surrounding said volume.

* * * * *